United States Patent [19]

Van Den Worm et al.

[11] 3,991,285

[45] Nov. 9, 1976

[54] MICROPHONE HAVING AN ELECTROSTATIC CARTRIDGE HAVING A STRUCTURAL ELECTRICAL RESISTOR

[75] Inventors: Freddy Eddy Van Den Worm; Petrus Antonius Swarte, both of Eindhoven, Netherlands

[73] Assignee: U.S. Philips Corporation, New York, N.Y.

[22] Filed: Sept. 23, 1974

[21] Appl. No.: 508,398

[30] Foreign Application Priority Data

Oct. 1, 1973 Netherlands ..... 7313455

[52] U.S. Cl. ..... 179/111 E; 179/121 R; 179/179; 179/190; 338/333; 338/334

[51] Int. Cl.[2] ..... H04R 1/02; H04R 3/00; H04R 19/00

[58] Field of Search ..... 179/1 A, 111 R, 111 E, 179/121 R, 179, 100.41 B, 100.41 G, 190; 307/88 ET; 338/271, 333, 334, 211, 212

[56] References Cited

UNITED STATES PATENTS

| | | | |
|---|---|---|---|
| 3,238,355 | 3/1966 | Van Eeck | 338/223 |
| 3,277,418 | 10/1966 | Norman et al. | 338/162 |
| 3,300,585 | 1/1967 | Reedyk et al. | 179/111 R |
| 3,412,358 | 11/1968 | Hummel et al. | 338/212 |
| 3,715,638 | 2/1973 | Polye | 338/334 |
| 3,731,009 | 5/1973 | Watanabe et al. | 179/100.41 X |
| 3,816,671 | 6/1974 | Fraim et al. | 179/111 E |
| 3,833,770 | 9/1974 | Atoji et al. | 179/111 E |

OTHER PUBLICATIONS

"High-Temperature Adhesive Tape Resistor" (No Author) Radio & Television News, Jan. 1952, vol. 47, No. 1, pp. 14 & 15.

*Primary Examiner*—George G. Stellar
*Attorney, Agent, or Firm*—Frank R. Trifari; Bernard Franzblau

[57] ABSTRACT

Microphone including an electrostatic microphone cartridge at least one of the electrodes of which is connected to a large resistor which forms part of an electronic circuit. The circuit may be the supply part or the input of the associated microphone amplifier which generally is incorporated in the cartridge. The large resistor is constituted by a structural component of the cartridge, which component is made of a weakly conductive synthetic material. The conductive synthetic material may be a conductive silicone rubber or a conductive polypropylene.

12 Claims, 5 Drawing Figures

MICROPHONE HAVING AN ELECTROSTATIC CARTRIDGE HAVING A STRUCTURAL ELECTRICAL RESISTOR

The invention relates to a microphone which has an electrostatic microphone cartridge at least one of the electrodes of which is connected to a large resistor of an electronic circuit.

Such a microphone is described in U.S. Pat. No. 3,300,585. The electrostatic microphone cartridge described includes an electret diaphragm which has the advantage of not requiring any external polarizing means. The microphone futher includes a built-in microphone amplifier, the input resistor — leakage resistor — of the first transistor stage being large, namely of the order of 100 megohms. The microphone amplifier including the large input resistor generally is in the form of an integrated circuit.

The present invention is characterized in that the resistor is constituted by a cartridge component which consists of a weakly conductive synthetic material.

This provides the advantage that a normal structural component, for example, a mount of a back electrode or a clamping ring of a diaphragm, in the microphone cartridge performs the additional function of a resistor, which provides a considerable saving in assembling the relevant electronic circuit, in general the microphone amplifier.

It should be mentioned that it is known to impart a controlled amount of conductivity to synthetic materials, which generally have an insulating property, by the admixture of small amounts of powdered metal or powdered carbon. Such synthetic materials are frequently used, for example, as the sheaths of cables (see U.S. Pat. No. 3,277,418, Netherlands patent application Nos. No. 6,514,033 and 6,609,499).

The large resistor may form a part both of the supply circuit for the polarising voltage and of the input circuit of the associated microphone amplifier.

One embodiment of the invention is a capacitor microphone the electrostatic cartridge of which fundamentally comprises a highly conductive diaphragm which, by means of an engaging first ring made of a weakly conductive synthetic material, is clampingly secured to an insulating mount which comprises the highly conductive back electrode and an engaging second ring made of a weakly conductive synthetic material, one ring forming part of the supply circuit and the other ring forming part of the input circuit of the microphone amplifier.

Another embodiment is a capacitor microphone the electrostatic cartridge of which includes an electret diaphragm, while an annular mount of the back electrode is made of a weakly conductive synthetic material and forms part of the input circuit of a microphone amplifier.

Good results are obtained by the use of a conductive silicone rubber and of conductive polypropylene.

The invention will now be described more fully with reference to the accompanying diagrammatic drawings, in which.

Figure 1:
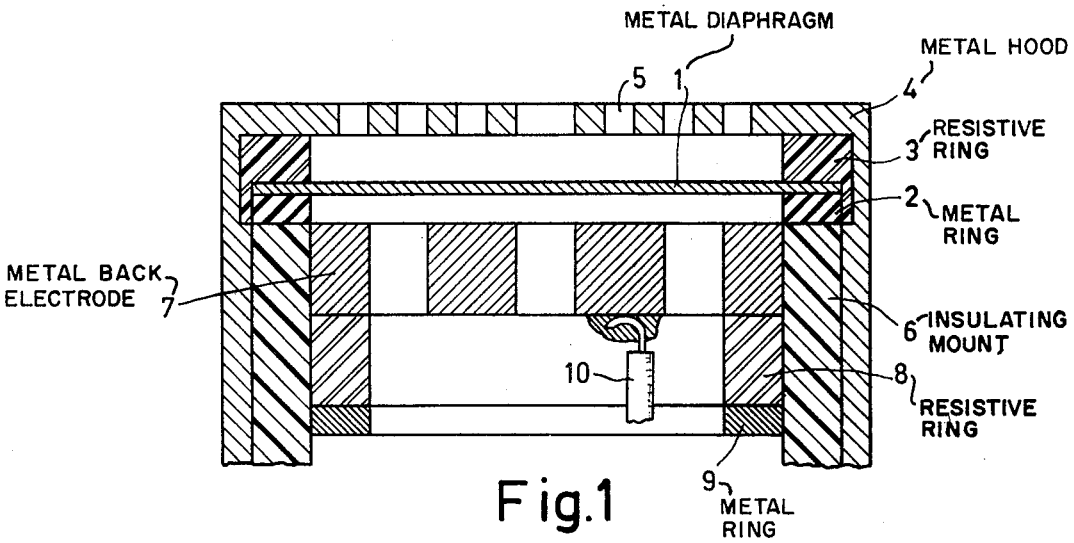
FIG. 1 is a part sectional view, part elevation of an electrostatic microphone provided with a ring and with a mount made of a weakly conductive synthetic material according to the invention.

Referring now to FIG. 1, the electrostatic microphone cartridge shown has a diaphragm 1 which is made of a metal or of a foil of a highly conductive polypropylene. The diaphragm is clampingly secured in the cartridge between two rings. The first ring 2 is highly conductive (metal); the second ring 3 is made of a weakly conductive material. The ring 3 engages a metal hood 4 the front wall of which is formed with a number of sound entrance openings 5.

The assembly comprising the diaphragm 1, the rings 2 and 3 and the hood 4 is secured to an insulating frame 6 which also serves as a mount for a metal back electrode 7. A closure ring 8 of a weakly conductive synthetic material engages the back electrode and is electrically connected to a metal ring 9.

The back electrode 7 is connected by a lead 10 to the input of a microphone amplifier (not shown) incorporated in the cartridge.

Figure 2:
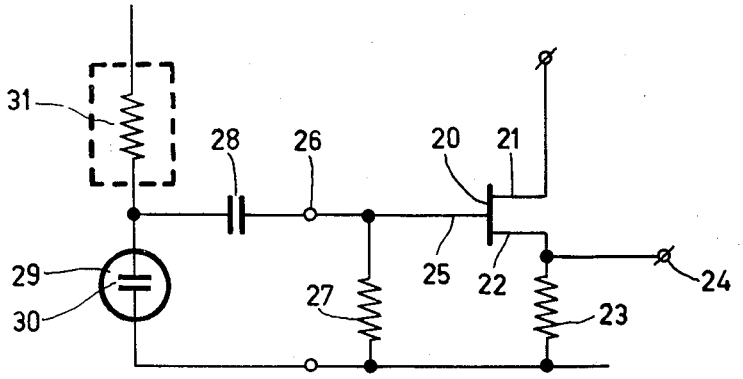
FIG. 2 is a schematic circuit diagram of the electrostatic microphone and of a part of the microphone amplifier in which the polarising resistor is a structural component of the cartridge.

The circuit diagram of FIG. 2 shows part of the input circuit of a microphone amplifier which includes a first transitor 20 of the FET type having a source electrode 21 which is connected to a supply voltage and a drain electrode 22 connected to a resistor 23 and to an output terminal 24.

A base electrode 25 is connected to an input terminal 26 and to a large leakage resistor 27. The input terminal 26 is connected through an input capacitor 28 to one of the electrodes of an electrostatic microphone 29. Also the polarizing voltage is applied to this electrode via a large resistor 31. This resistor 31 is the weakly conductive ring 3. The other electrode 30 of the electrostatic microphone is connected to the resistors 27 and 23.

In this circuit the rings 8 and 9 of the microphone cartridge are not used.

Figure 3:
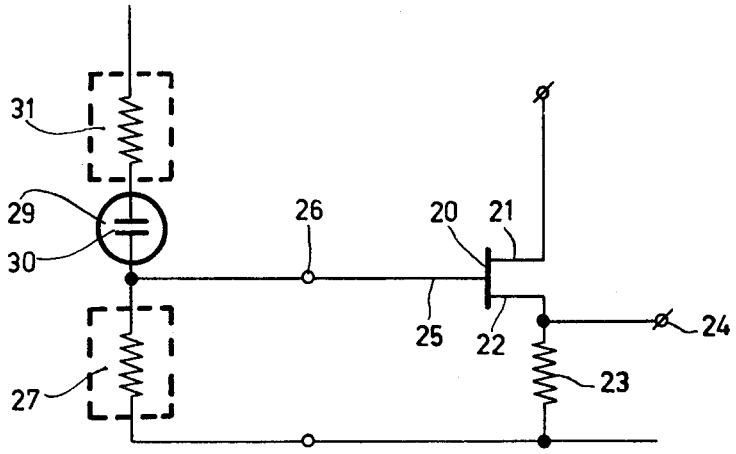
FIG. 3 is a similar circuit diagram in which the leakage resistor of the input transistor also is a structural component of the cartridge.

In the circuit shown in FIG. 3, the electrostatic microphone is connected in the supply branch for the polarizing voltages. The resistor 31 again comprises the weakly conductive ring 3, but now the leakage resistor 27 comprises the weakly conductive retaining ring 8.

Figure 4:
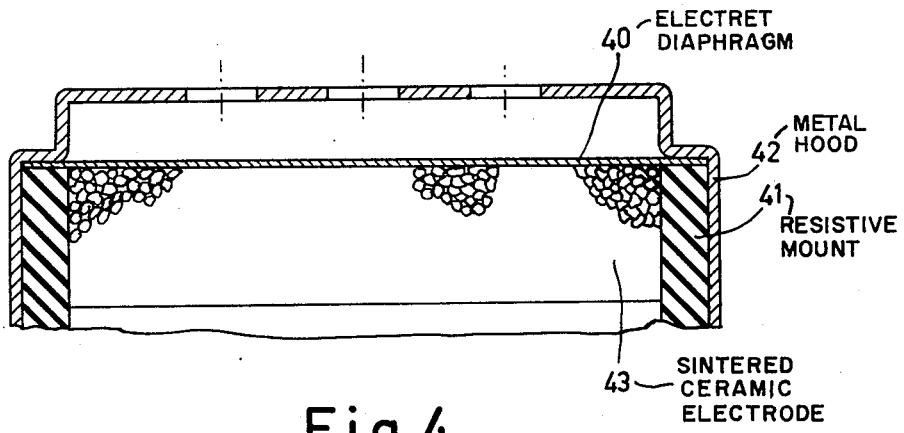
FIG. 4 is a sectional view of an electret capacitor microphone having a mount made of a weakly conductive synthetic material.

FIG. 4 shows part of a capacitor electret cartridge. A diaphragm 40 comprising an electret foil is clampingly secured to an annular mount 41 by a metal hood 42. The mount 41 encloses a back electrode 43 which consists of a sintered ceramic material. The mount 41 is made of a weakly conductive synthetic material and has an overall resistance of between 200 megohms and 1,000 megohms.

Figure 5:
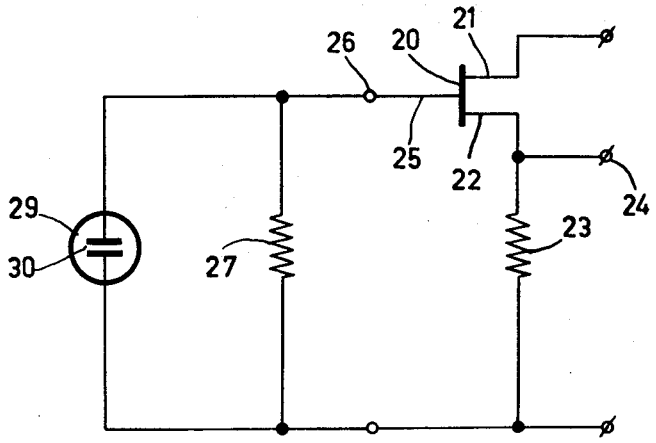
FIG. 5 is a circuit diagram of the input circuit of the microphone amplifier including the electret capacitor microphone of FIG. 4.

In the microphone amplifier circuit diagram of FIG. 5 the electret capacitor cartridge 29 is connected in parallel with the leakage resistor 27 to base 25 of the input transistor 20. The resistor 27 is the mount 41 (FIG. 4) made of a weakly conductive synthetic material.

What is claimed is;

1. A microphone comprising, an electrostatic transducer cartridge comprising an acoustic diaphragm mounted within the cartridge casing, a cartridge electrode connected to a large resistor forming a component of an electronic circuit, said resistor being formed as a structural component of the cartridge which component is made of a weakly conductive synthetic material and the resistor component itself further providing a substantial mechanical function within the cartridge independent of its electric function in said electronic circuit.

2. A microphone as claimed in claim 1 characterized in that the resistor forms part of the supply circuit for the cartridge polarizing voltage and is directly connected to said diaphragm.

3. A microphone as claimed in claim 1, characterized in that the resistor forms part of the input circuit of a microphone amplifier.

4. A transducer device as claimed in claim 1 wherein said diaphragm comprises an electret diaphragm and said resistor structural component comprises an annular mount for said diaphragm that engages said electrode, the annular mount resistor forming a part of the input circuit of said electronic circuit.

5. A transducer device as claimed in claim 1 wherein the structural component comprises a member made of a synthetic insulating material loaded with electrically conductive particles so that the entire structural component makes up a resistor component of the electronic circuit having a predetermined resistance value suitable to perform its designated electric function in the electronic circuit.

6. A microphone as claimed in claim 1 characterized in that the synthetic material comprises a conductive silicone rubber.

7. A microphone as claimed in claim 1 characterized in that the synthetic material comprises a conductive polypropylene.

8. An electroacoustic transducer device comprising, an electrostatic transducer cartridge comprising a diaphragm made of a highly conductive material, an insulating mount fitted within the cartridge, means for clamping the diaphragm to the insulating mount including a first ring made of a weakly conductive synthetic material that engages the diaphragm, said first ring exhibiting a large electrical resistance characteristic and forming a resistor component of an amplifier circuit for said transducer device.

9. A transducer device as claimed in claim 8 wherein the transducer cartridge further comprises, a high conductive electrode engaging the insulating mount, a second ring in contact with said electrode and made of a weakly conductive synthetic material that exhibits an electrical resistance characteristic, said second ring forming a second resistor component of said amplifier circuit.

10. A transducer device as claimed in claim 8 further comprising an electrode, a second ring in contact with said electrode and made of a weakly conductive synthetic material that exhibits an electrical resistance characteristic, and wherein the first ring resistor forms a part of the amplifier supply circuit and the second ring resistor forms a part of the amplifier input circuit.

11. An electroacoustic transducer device comprising, a microphone cartridge that comprises an electret diaphragm, an annular mount supporting the electret diaphragm and made of a weakly conductive synthetic material that forms a resistor component of a microphone amplifier, and a back electrode in contact with said annular mount.

12. A transducer device as claimed in claim 11 wherein the back electrode comprises a sintered ceramic material located within the annular mount to form a capacitor with said diaghragm so that the capacitor and the annular resistor mount are both a part of the electrical input circuit of said amplifier.

* * * * *